US005630551A

United States Patent [19]

Forcier

[11] Patent Number: 5,630,551

[45] Date of Patent: May 20, 1997

[54] IN-GROUND RECIPROCATING SPRINKLER

[76] Inventor: Mitchell D. Forcier, 417 Kirby Ct., Walnut Creek, Calif. 94598

[21] Appl. No.: 453,870

[22] Filed: May 30, 1995

[51] Int. Cl.[6] ..... B05B 3/08

[52] U.S. Cl. ..... 239/563

[58] Field of Search ..... 239/240, 292, 239/DIG. 1, 563, 564, 415, 528, 567, 581.1; 137/594, 625.11, 625.12, 625.16, 628

[56] References Cited

U.S. PATENT DOCUMENTS

| | | | |
|---|---|---|---|
| 1,667,964 | 5/1928 | Beddoes | 239/DIG. 1 X |
| 1,760,903 | 6/1930 | Honkel | 239/240 |
| 1,983,929 | 12/1934 | Buelna et al. | 239/240 X |
| 2,693,390 | 11/1954 | Spendor et al. | 239/242 X |
| 3,272,437 | 9/1966 | Coson | 239/240 X |
| 3,332,624 | 7/1967 | Rinkewich | 239/242 |
| 3,815,832 | 6/1974 | Floyd | 239/DIG. 1 X |
| 4,353,507 | 10/1982 | Kah, Jr. | 239/240 |
| 4,417,691 | 11/1983 | Lockwood | 239/206 |
| 4,568,023 | 2/1986 | Hayes | 239/242 |
| 4,721,248 | 1/1988 | Chow | 239/242 |
| 5,052,621 | 10/1991 | Katzer et al. | 239/242 |

FOREIGN PATENT DOCUMENTS

| | | | |
|---|---|---|---|
| 73312 | 6/1979 | Japan | 239/DIG. 1 |
| 2094181 | 9/1982 | United Kingdom | 239/240 |

OTHER PUBLICATIONS

Product—Whisper Quiet Sprinkler, NAAN Sprinklers and Irrigation Systems, Inc., Cerritos, CA—Model 525-C.

*Primary Examiner*—Kevin Weldon

*Attorney, Agent, or Firm*—Marger, Johnson, McCollom & Stolowitz

[57] ABSTRACT

An apparatus and method for dispensing water in a radially uniform distribution over a surface. The reciprocating sprinkler device includes a housing, an inlet port for receiving water under pressure to the housing, at least two outlet ports capable of dispersing water in differing directions, and a reciprocating water driven valve. Each outlet port includes an opening for receiving water from within the housing. The reciprocating valve alternately covers portions of the outlet port openings as it moves, thereby modulating the flow of water between the outlet ports resulting in increasing and decreasing flows of water across a surface.

6 Claims, 8 Drawing Sheets

QUARTER CIRCLE

HALF CIRCLE

FULL CIRCLE

IN-GROUND RECIPROCATING SPRINKLER

BACKGROUND OF THE INVENTION

This invention relates generally to sprinkler systems and more particularly to water driven reciprocating lawn sprinklers.

Sprinklers have been used for many years to provide enough moisture upon a surface, such as a lawn or garden, to ensure that plants growing on such surface have sufficient irrigation to support healthy growth and prevent disease or even dying. In recent years, moveable above-ground oscillating sprinklers, such as U.S. Pat. Nos. 3,332,624, 4,721,248 and 4,568,023 have been developed to provide a more uniform spray pattern over a more or less rectangular area. Such oscillating sprinklers are usually driven by a "water motor" or the like, such as is disclosed in U.S. Pat. Nos. 4,417,691 or 5,052,621 which conventionally moves the spray nozzle to point in a different direction over the spray cycle period. This allows even coverage because the water droplets impact the ground uniformly as the sprinkler oscillates.

FIG. 1 shows a conventional oscillating sprinkler at 10. Oscillating sprinkler 10 includes an elongate hollow tube 12 having a plurality of apertures 14 located along its length through which water is forced outward under pressure. At an interface 16 located at one end of tube 12, a water source, such as hose 18, is connected. Interface 16 includes water driven gearing means (not shown) for rotating tube 12 along a longitudinal axis. Finally, sprinkler 10 includes frame 20 to provide stability to the structure on which tube 12 and interface 16 are mounted. As a result of water pressure supplied through hose 18 to interface 16, the gearing means are turned, thereby oscillating tube 12 through a predetermined arc and thus dispersing water, as shown in FIG. 2, in a rectangular pattern centered about sprinkler 10.

FIG. 2 includes a diagram showing the water dispersal characteristics of oscillating sprinkler 10. The maximum distance at which water may be dispersed from the oscillating sprinkler is shown as D and is dependant upon the water pressure, the size of apertures 14, and the topography of the surface to be watered. On flat surfaces, oscillating sprinklers have the advantage of dispersing water evenly throughout an area, as illustrated in the FIG. 2C graph showing the amount of water dispersed as a function of distance from the sprinkler. Note that water dispersal is fairly uniform across the entire watering range D.

Another type of lawn irrigating sprinkler is the fixed, in-ground system comprising a number of sprinkler heads coupled to an underground piping system. FIG. 3 shows a conventional sprinkler head 30 used with in-ground sprinkler systems. Sprinkler 30 comprises a housing 32 having a female pipe thread 34 located at one end of the housing and a water outlet 36 located at the opposite end. Housing 32 is generally made of a hard plastic material that resists wear and is immune to rust. Pipe thread 34 is conventionally sized to screw onto a standard pipe fitting on most in-ground sprinkler systems. Water supplied to housing 32 through female thread 34 is shunted to the outlet 36 where it contacts deflector 38 and is dispersed radially from the sprinkler head.

Current in-ground sprinkler systems rely on a constant water flow at each sprinkler head. The flow can be adjusted at the sprinkler head and at the valve to the sprinkler group. It is normally adjusted once during sprinkler installation, allowing water to reach vegetation while avoiding things that should remain dry (fences, windows, etc).

FIG. 4 shows the dispersal of water from sprinkler 30. The maximum distance at which water may be dispersed from sprinkler 30 is shown as radius R and is dependant, like the oscillating sprinkler, upon the water pressure, the size of outlet 36, and the topography of the surface to be watered. Because the pressure and flow of water through the outlet is constant, however, most of the water is dispersed a predominantly constant distance from the sprinkler head. FIG. 4C includes a graph showing the uneven radial dispersal of water from the sprinkler head.

Current automated and manual in-ground sprinkler systems rely upon overlapping spray patterns from a series of sprinkler heads in order to assure coverage of an area being watered. Spray patterns typically cover a full or partial circle. The full/partial circle spray pattern is created by one or more water outlets on the sprinkler head. Each water outlet shapes and deflects water in a specific direction, normally at an upward angle. Spray patterns larger than a half circle are usually produced by a sprinkler head with two water outlets—one for each half of the pattern.

When planning a sprinkler system, the radius of the spray pattern is determined for purposes of spacing the individual sprinklers. The sprinklers are typically separated by a distance equal to this radius in order to prevent unirrigated spots from existing. Because the spray from a sprinkler is normally up and away from the sprinkler at a constant flow rate, unlike the oscillating sprinkler shown in FIG. 1, a poorly irrigated area will exist near the sprinkler head unless the overlapping spray of another sprinkler can reach the "dry" area. The water coverage from a single conventional in-ground sprinkler is shown in FIG. 4. The collision of airborne drops of water from one sprinkler with drops from another sprinkler helps to assure complete coverage of the area being watered.

FIG. 5A shows a typical sprinkler configuration for a square section of grass. A full circle sprinkler head, such as sprinkler head 50, is located at the center of the square. Sprinkler 50 disperses water out to a radius, shown in dashed lines, sufficient to reach a boundary of the square section. A half-circle sprinkler head, such as sprinkler head 52, is placed at the midpoints of each of the square sides of the lawn. Sprinkler 52 disperses water in a 180 degree arc out to a radius shown by the dot-dashed line. Finally, a quarter circle sprinkler head, such as sprinkler head 54, is placed at each of the corners of the lawn to irrigate out to a radius shown by the 90 degree arc dotted lines.

Current sprinkler systems are adequate for irrigating a flat area when the sprinkler head spacing described above is used. When the lawn area is not flat or obstacles exist (tree roots, etc.) interfering with the sprinkler head spacing needed to create overlapping spray, a portion of the lawn will not receive adequate irrigation. This will cause a "dry patch" to exist on the lawn.

As a result of the necessity of overlapping spray patterns for uniform irrigation, more sprinkler heads are required. Additionally, placement of each sprinkler head is critical to reaching all portions of the lawn due to the inherent irregular watering patterns of conventional inground sprinkler heads.

Accordingly, a need remains for a compact sprinkler device which combines the ability to uniformly water an area as with an oscillating sprinkler, yet be compatible with existing in-ground sprinkler systems.

SUMMARY OF THE INVENTION

It is, therefore, an object of the invention to distribute the water output from a circular sprinkler head in a radially uniform manner.

Another object of the invention is to minimize the number of overlapping circular or semi-circular spray patterns needed to uniformly water an area.

The reciprocating sprinkler device constructed in accordance with the present invention dispenses water uniformly over a surface and includes a housing, an inlet port for receiving water under pressure to the housing, at least two outlet ports, and a reciprocating valve drive mechanism arranged for modulating the flows of water through the two or more ports to distribute the water radially. Each outlet port has a receiving end in fluid communication with water entering the housing from the inlet port and a dispersing end external from the housing. The reciprocating valve drive mechanism is powered by fluid communication with the inlet pressure to shunt varying flows of water between the outlet ports so as to reciprocally increase and decrease the flows from each outlet port, thereby distributing the flows radially from the sprinkler device.

In its preferred embodiment, the reciprocating valve alternately covers portions of the outlet port openings as it rotates, thereby modulating the flow of water between the outlet ports resulting in oscillating flows of water across a surface. A valve gear can be meshed with the reciprocating valve to reduce the valve rotation rate in order for the device to operate under low water pressure situations. The reciprocating valve can have a variety of shapes in order to modify the differential flows of water through the differing outlet ports.

The method for uniformly dispersing water in an area includes driving the water under pressure toward a first and second dispersing outlet port within the sprinkler housing. Each outlet port then has a corresponding outlet pressure. A radially extending spray pattern is created by periodically varying the outlet pressures so that the pressures of one outlet port is decreasing when the pressure at another outlet port is increasing. By reciprocally varying the pressure between the outlet ports, water is dispersed from the sprinkler device continuously over a surface, thus allowing placement of the sprinkler devices with minimally overlapping patterns.

The present invention offers several advantages. First, the reciprocating nature of the invention offers more uniform water coverage. Secondly, there are lower material and installation costs from using much fewer sprinkler heads and pipe connection. Less hardware means a shorter installation time and less maintenance because there are fewer sprinkler heads to adjust or replace. Finally, the aesthetic value of the lawn increases because less hardware can be observed.

The foregoing and other objects, features and advantages of the invention will become more readily apparent from the following detailed description of a preferred embodiment of the invention which proceeds with reference to the accompanying drawings.

DETAILED DESCRIPTION

The reciprocating sprinkler constructed according to the present invention uniformly applies water to a lawn without the requirement of overlapping spray, thus preventing dry patches. A minimal amount of spray pattern overlap will always exist when sprinklers producing a circular spray pattern are used to water a rectangular lawn area. Reciprocating sprinkler heads can be spaced to accommodate the minimal overlap, resulting in a sprinkler system that requires less hardware than a conventional sprinkler system.

Each reciprocating sprinkler head assures coverage of its target area by continuously varying the flow of water from a low rate to a high rate. At the lowest rate, the area nearest the sprinkler head gets watered. At the highest rate, the area at the outer limits of the sprinkler's spray pattern gets watered. This allows the sprinklers to be separated coincidentally by distances up to the maximum diameter of the sprinkler spray pattern.

Figure 1:
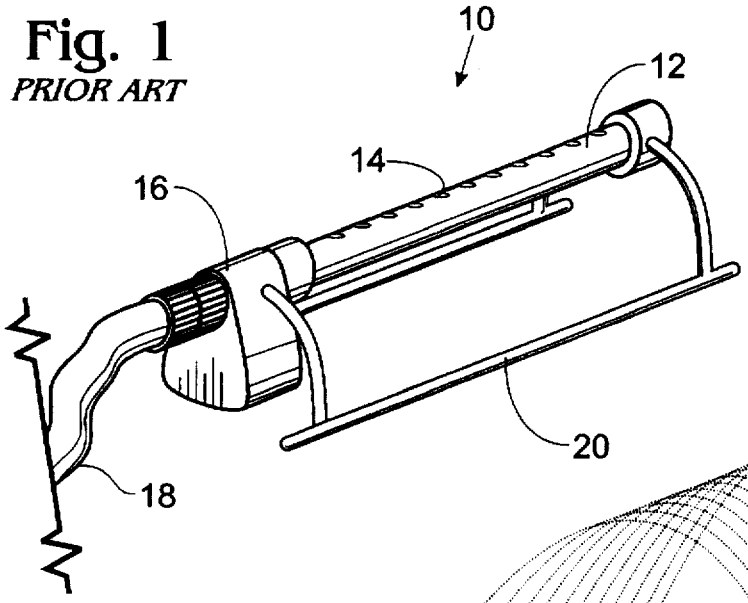
Fig. 1 PRIOR ART
FIG. 1 is a perspective view of a conventional oscillating sprinkler.
Figure 2A:
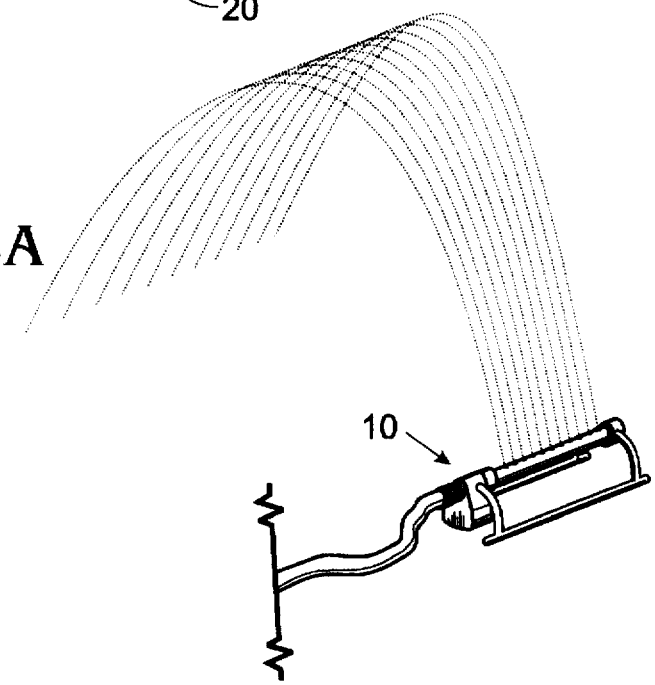
FIG. 2 shows the sprinkler of FIG. 1 in operation and its corresponding area of coverage including a graph showing the dispersal characteristics within a certain distance from the sprinkler.
Figure 2B:
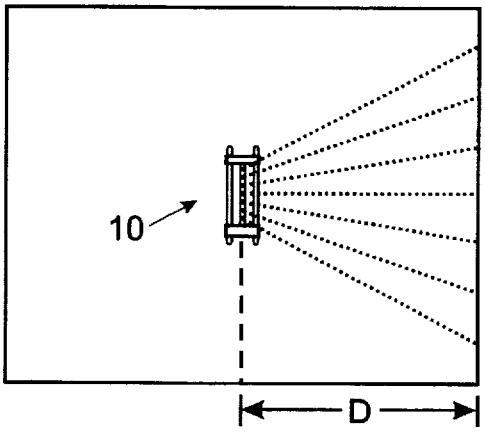
Figure 2C:
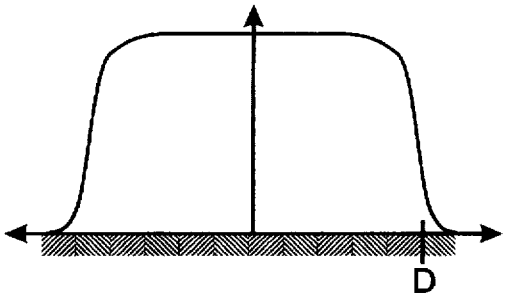
Figure 3:
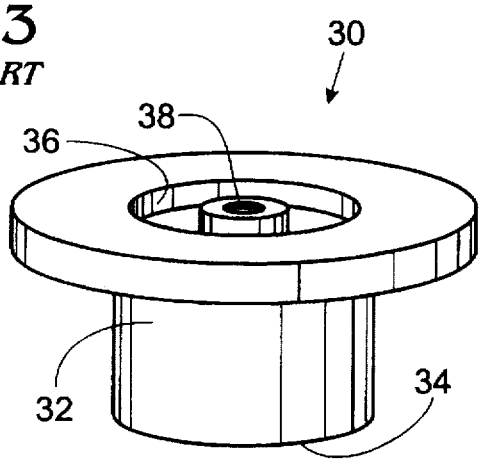
Fig. 3 PRIOR ART
FIG. 3 is a perspective view of a conventional sprinkler head used for in-ground sprinkler systems.
Figure 4A:
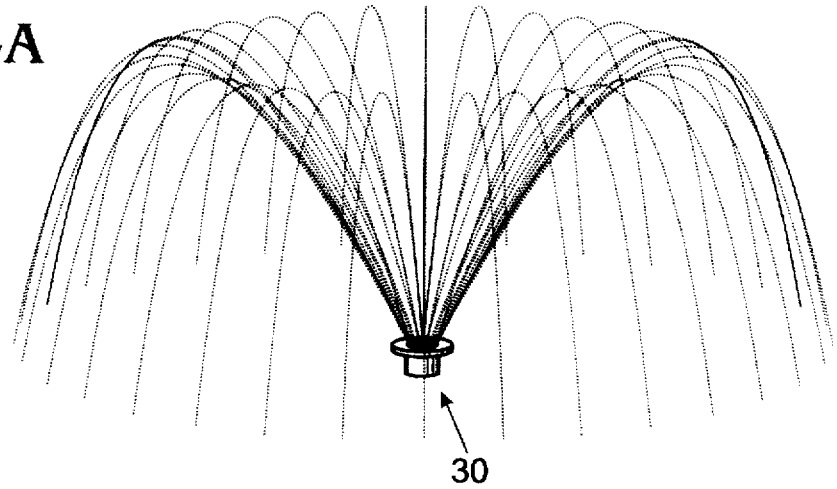
FIG. 4 shows the sprinkler of FIG. 3 in operation and its corresponding area of coverage including a graph showing the dispersal characteristics within a certain distance from the sprinkler.
Figure 4B:
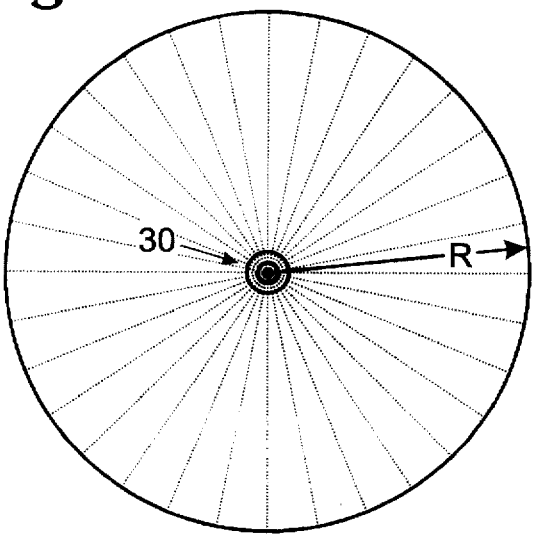
Figure 4C:
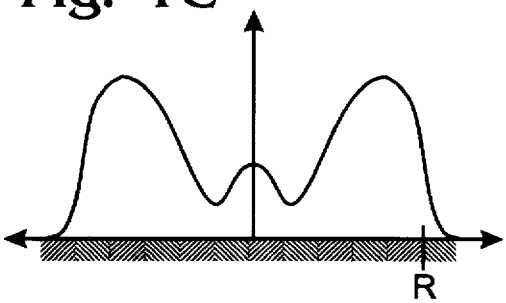
Figure 5B:
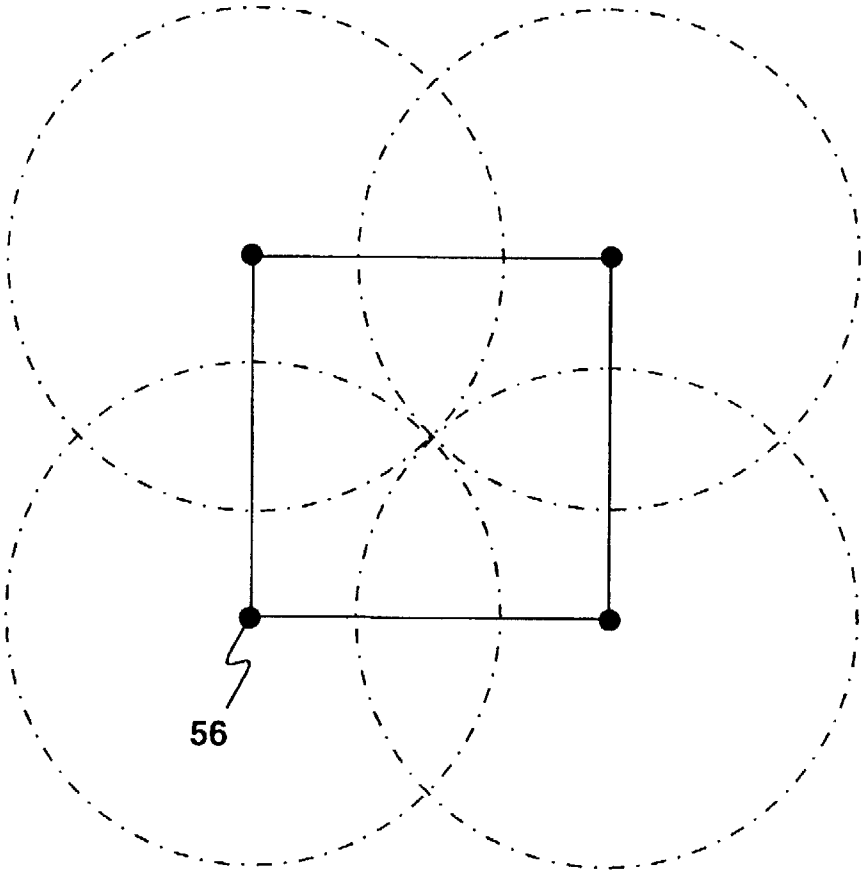
FIG. 5 is a diagram comparing the distribution of sprinkler heads required to form an overlapping spray pattern using the prior art devices of FIG. 3 and sprinkler heads constructed according to the present invention.
Figure 5A:
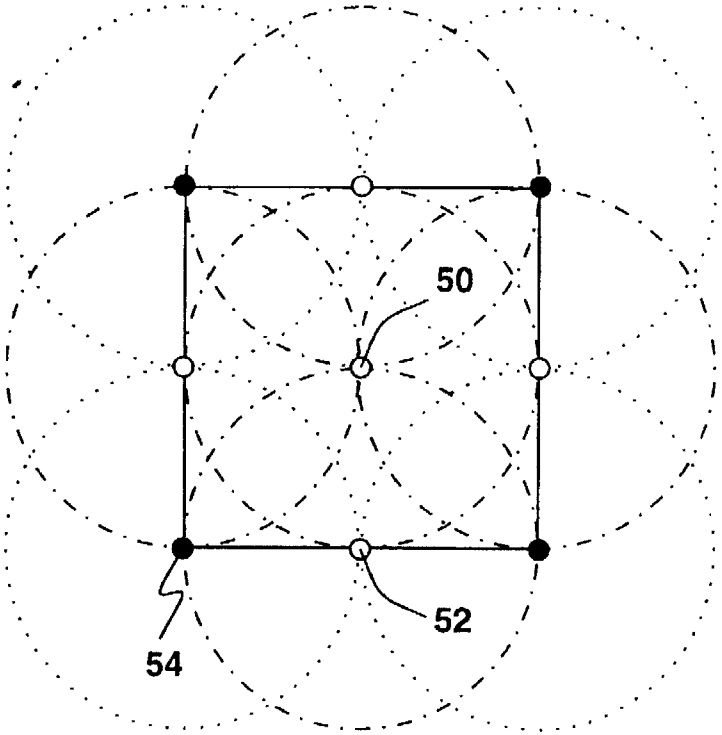

A minimal sprinkler system would consist of a single sprinkler head for watering a circular lawn. Most lawns are not circular though. For a square lawn a minimal amount of spray overlap will exist due to the sprinklers being positioned in a manner that allows the spray pattern to reach the center of the square. This is shown in FIG. 5B.

Figure 6:
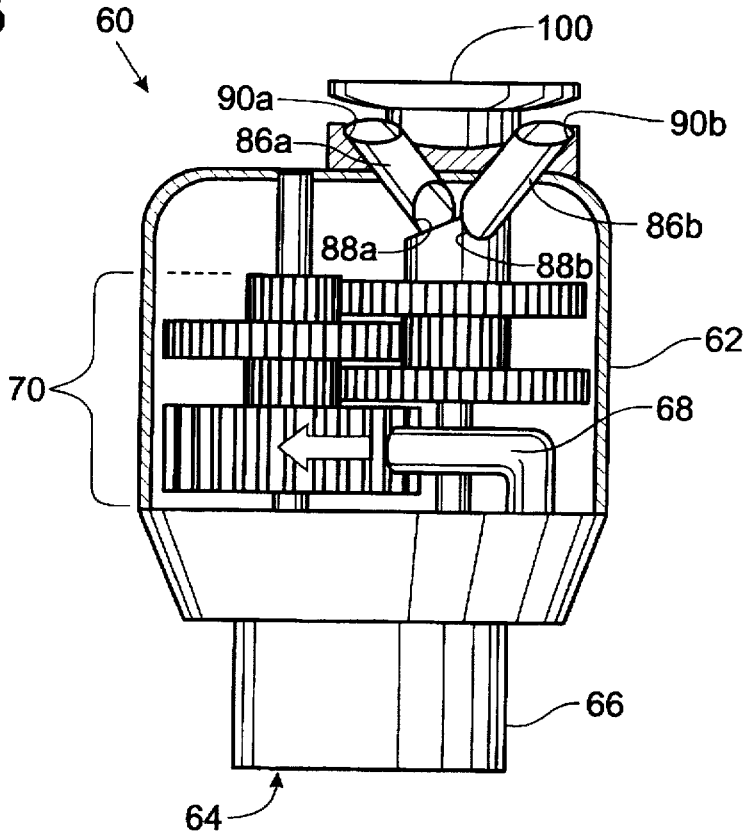
FIG. 6 is a cross sectional schematic view of a reciprocating sprinkler constructed in accordance with the present invention.

FIG. 6 shows a cross sectional schematic view of an example of a reciprocating sprinkler 60 constructed in accordance with the present invention. Sprinkler 60 includes a housing 62, preferably constructed of a rigid and noncorrosive material such as plastic. With the exception of the inlet and outlet ports described below, housing 62 is a closed system of sufficient strength to withstand pressurization when the housing is filled with water.

Water is received under pressure into housing 62 through inlet port 64 located on the bottom of the housing. The inlet port includes a collar 66 which threads into a conventional in-ground sprinkler system. The water flowing through the inlet port is redirected by chute 68 to impact upon a water powered drive mechanism 70 which is in fluid communication with the inlet pressure. The initial direction of the inlet pressure within the housing is shown in FIG. 6 by the arrow originating from chute 68.

Figure 7:
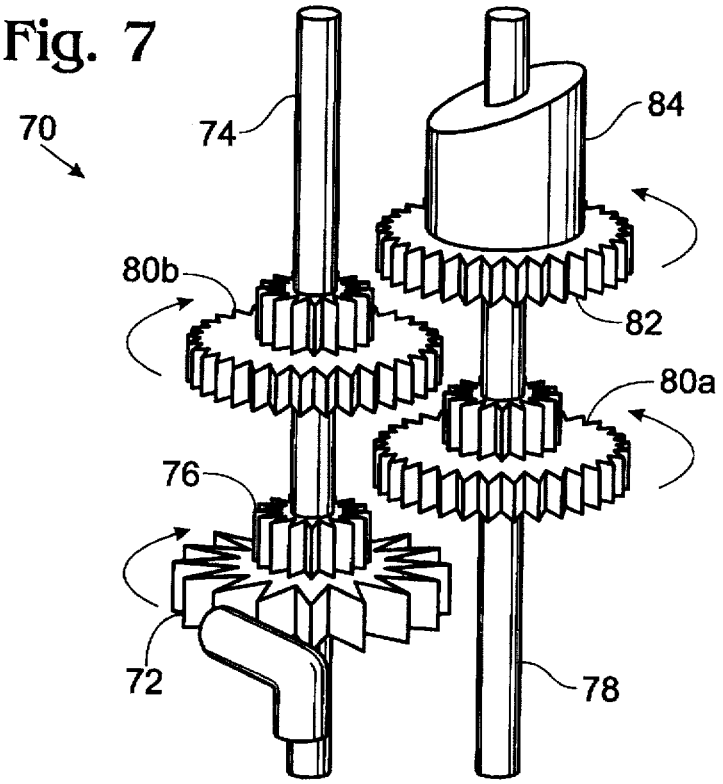
FIG. 7 is a perspective view of the sprinkler of FIG. 6 showing the valve and drive mechanism in greater detail.

FIG. 7 shows the water powered drive mechanism 70 in greater detail. An impeller or rotor 72, located adjacent the inlet port, is responsively driven by the fluid inlet pressure. Rotor 72 is coupled to rotor drive gear 76 wherein both rotate as a unit on shaft 74. A second shaft 78 is located parallel to shaft 74. Gearing ratio means, shown by meshed gears 80*a* and 80*b*, are mounted on shafts 74, 78 and have a certain predetermined teeth-to-circumference ratio for decreasing the force necessary to turn rotor 72. Gear 80*b* is further meshed with valve gear 82, mounted on shaft 78, which is coupled to a reciprocating valve 84. Arrows show the rotation direction of gears 76, 80*a*, 80*b* and 82 when rotor 72 is turned by the water pressure.

Valve 84 is rotated by the water powered drive mechanism 70 to shunt varying flows of water between outlet ports 86*a* and 86*b*. Preferably, the reciprocating valve shunts the varying flows of water by selectively covering a variable portion of the outlet port openings (shown as receiving ends 88*a* and 88*b*) in response to the water powered drive mechanism. The effect of the distributive action of valve 84 between the outlet ports reciprocally increases and decreases the flows from each outlet port to distribute the flows radially from the sprinkler.

The SUM of the water flows at any point in time through the two outlets is preferably a constant. This is represented in the following equation: Flow at outlet one+Flow at outlet two=N Gallons Per Minute. The constant water flow through each sprinkler head also assures that the mechanism controlling the flow oscillations operates at a constant and reliable speed.

Each of ports 86*a*, 86*b* have outlet openings or receiving ends 88*a*, 88*b* in fluid communication with fluid entering the housing from inlet port 64, and dispersing ends 90*a*, 90*b* external from the housing. The outlet openings 88*a* and 88*b* are positioned 180 degrees opposite of each other at the same vertical position. Receiving ends 88*a*, 88*b* define a preferably circular opening, although other opening shapes may be used in conjunction with differently shaped reciprocating valves as discussed in more detail below.

Figure 8:
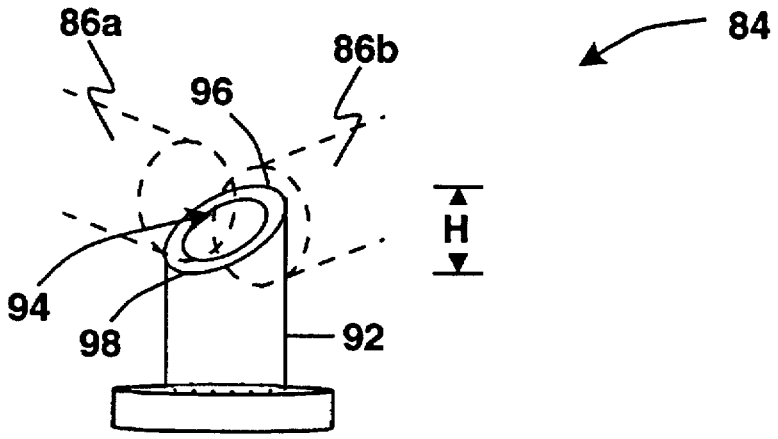
FIG. 8 is a perspective view showing one embodiment of the flow valve used in the present invention.

FIG. 8 shows the preferred embodiment of reciprocal valve 84. Valve 84 includes a cylindrical outer surface 92 which abuts the outlet port receiving end openings 88*a* and 88*b*. The preferred reciprocating valve is shaped by bisecting the elongate cylinder with an angled plane thus forming a sloped top surface 94 having a high end 96 and a low end 98. The height difference H between the high end and low end is less than or equal to the outlet port openings 88*a*, 88*b* so that rotation of the cylindrical valve past the outlet openings selectively covers a variable portion of the openings. Normally the high point 96 of the flow valve will be at or below the high point of the outlet openings and the low point 98 of the flow valve will be at or above the low point of the outlet openings. If the high end of the sloped surface 96 is below the top of the outlet openings, water will flow through both outlets at all times. This "minimal" output from the sprinkler head could be adjustable by making the flow valve vertically adjustable. The action of the valve causes only a reciprocally varying portion of each of the valve openings to be able to receive water therethrough, thus regulating the flow of water through the valve. Consequently, a full flow cycle (varying from a starting flow rate until that rate is once again attained) will be completed for each water outlet with a full rotation of the valve.

A flow of water through the reciprocating sprinkler head drives the set of gears 70 that varies the position of the flow valve as shown in FIG. 12. The flow valve simultaneously regulates the flow of water through both water outlet ports 86*a*, 86*b* on the sprinkler head, creating water oscillations. As the flow valve 84 turns, water flow to one outlet is decreased while flow to the other outlet is increased. Once maximum flow to the second outlet is achieved, its flow begins to decrease as the flow to the first outlet is increased. This cycle repeats as long as water flows through the sprinkler head.

The speed at which the water oscillations occur is a function of the water flow rate at the water inlet, the gearing of the mechanism that turns the flow valve, and the shape of the flow valve. Water flow into the sprinkler head will be adjustable at the water inlet. Reducing the flow substantially will reduce the maximum diameter of the spray pattern and cause the mechanism to slow down, resulting in slower water oscillations.

It is conceivable that water flow could be adjusted at each water outlet. If each outlet had a different flow rate, irregular spray patterns would result and the duration of water flow through the outlet having the lowest maximum flow might be longer than that of the other outlet. Additionally, the water pressure within a sprinkler system having multiple sprinkler heads might fluctuate since the water flow through any one sprinkler would not be guaranteed to be constant. For these reasons it is preferable to adjust the water flow at the water inlet rather than the water outlets.

Figure 12A:
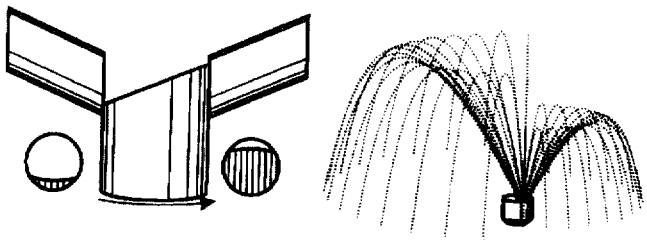
FIG. 12 is a perspective view showing in five steps (FIGS. 12A–E) the progressive modulation of water through the outlet ports as regulated by the flow valve shown in FIG. 8.

FIGS. 12A through 12E show five positions of the valve corresponding to steps in a half cycle or half revolution of the valve, together with a corresponding diagram of spray distribution. The valve positions relative to the outlet port openings, the portion of the openings covered and the corresponding water flow are also shown. FIG. 12A shows a first position in which most of outlet port opening 88*a* is open, while most of opening 88*b* is closed. The resulting water flow causes the sprinkler head to disperse water primarily to the left through dispersing end 90*a*.

Figure 12B:
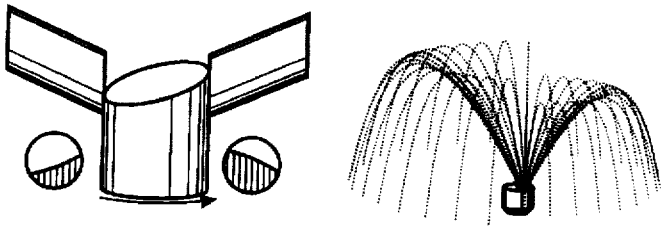
Figure 12C:
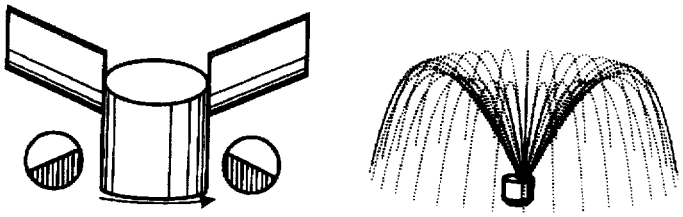
Figure 12D:
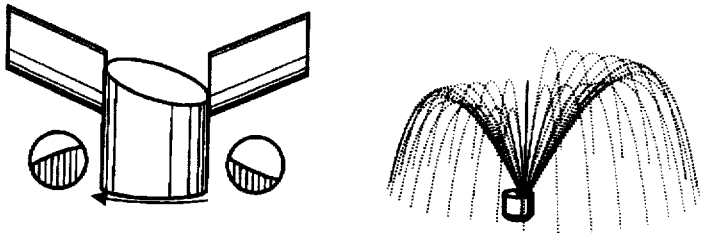
Figure 12E:
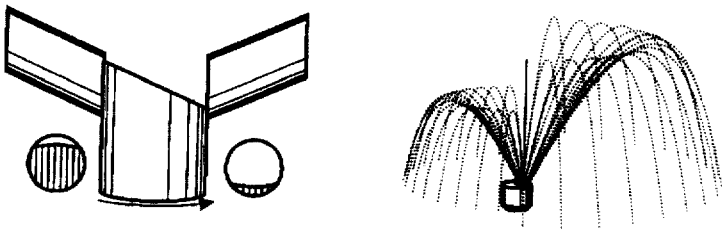

As the reciprocating valve rotates to a second position, shown in FIG. 12B, opening 88*a* is slowly covered by the valve's abutting cylindrical surface while opening 88*b* is slowing opened. The water flow is more evenly dispersed through dispersing ends 90*a*, 90*b* so that water is ejected from the sprinkler head almost as far to the right as to the left. FIG. 12C shows the valved ports equally (half) open and FIG. 12D show the continued trend wherein opening 88b is uncovered as opening 88*a* is closed. Finally, FIG. 12E shows opening 88*a* almost completely closed by the reciprocating valve thus allowing only a small flow of water to the left side. As the valve rotates further, the water dispersal characteristics progress in reverse order from FIG. 12E to FIG. 12A and back again. This modulating cycle oscillates continuously, thereby evenly distributing water to a circular portion of the lawn or other area sprinkled.

The outlet port openings 88*a* and 88*b* are preferably located on opposite sides of the cylindrical valve of FIG. 8 at the same vertical position to effect constant flow of water through the outlet ports. Other valve shapes might require the openings to be placed in different locations about the valve's cylindrical outer surface so that one opening is being progressively opened while another is being closed.

Figure 9:
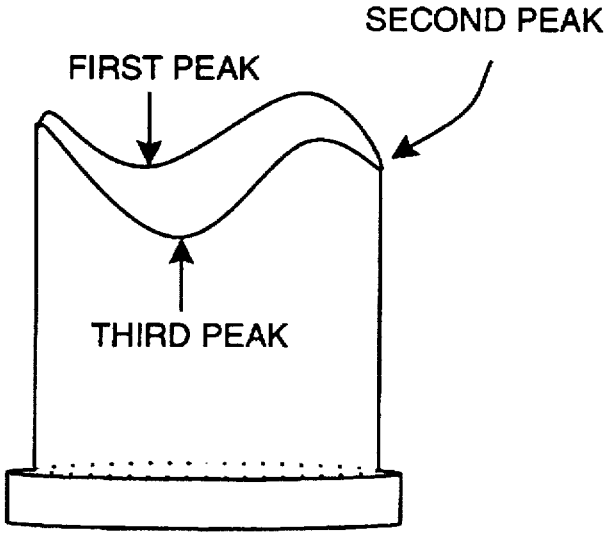
FIG. 9 is a perspective view showing another embodiment of the flow valve constructed in accordance with the present invention.

FIG. 9 shows an alternate embodiment of reciprocating valve 84 allowing three cycles or peaks per rotation of the valve. With a flow valve of this shape, three full flow cycles will be completed for each water outlet with a full rotation of the valve. The best shape for the flow valve is best determined empirically. The mechanism that turns the flow valve must have enough gearing to turn the flow valve under normal operating conditions even if the water flow at the inlet is minimal. The gearing will therefore determine the maximum rate at which the flow valve can turn. If the water oscillations were too "slow" given the required gearing, a multi-peak flow valve could be used to "speed up" the oscillations. Other embodiments which act to cover variable portions of the outlet port openings are equally feasible, particularly those providing an odd number of peaks.

Figure 10:
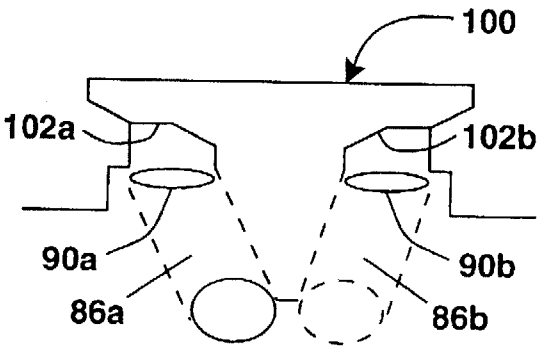
FIG. 10 is a cross sectional schematic view showing the water deflecting portion and FIGS. 10A, 10B and 10C show possible spray patterns of the sprinkler of FIG. 6 in greater detail.
Figure 10C:
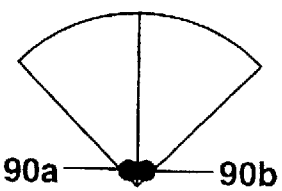
Figure 10B:
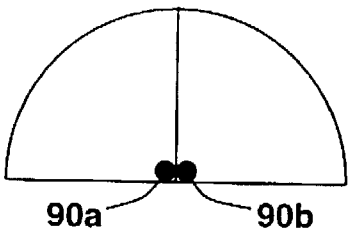
Figure 10A:
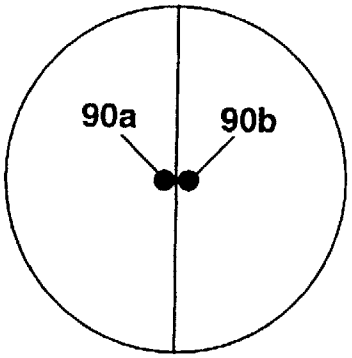

Sprinkler 60 preferably includes a spray deflector 100 located adjacent each of the dispersing ends 90*a*, 90*b* of outlet ports 86*a*, 86*b*. FIG. 10 shows one suitable form of deflector in greater detail. The deflectors include shaped surfaces 102*a*, 102*b* which guide or shape the water path in desired directions, such as in a 45 degree arc, a 90 degree arc, or even a 180 arc. The deflectors generally guide water in a fixed direction but the deflector could rotate to allow both reciprocal and rotational irrigation.

Figure 11C:
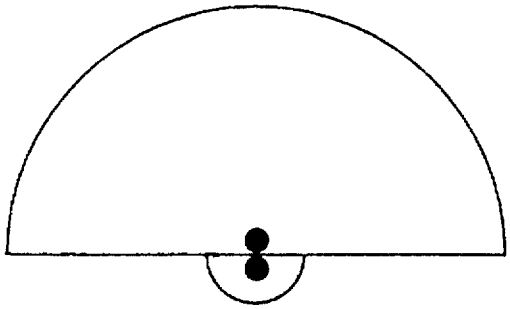
FIG. 11 is a plan view showing the distribution of water by the sprinkler of FIG. 6 in three steps over a half-cycle period.
Figure 11B:
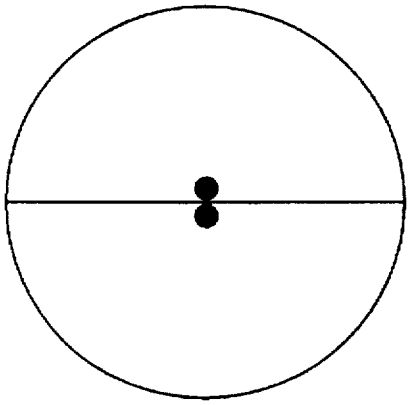
Figure 11A:
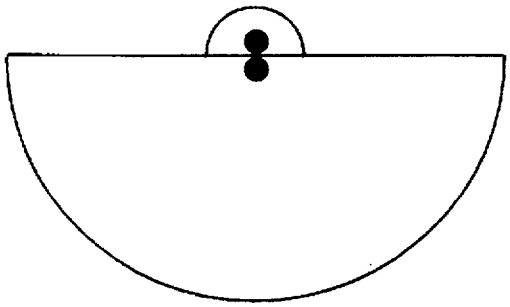

Each reciprocating sprinkler head maintains a constant water flow. In a two-port sprinkler, when one outlet has full flow the another outlet will have little or no flow. When one outlet has half flow, another outlet will have half flow (see FIG. 11). This maintains the integrity of the entire sprinkler system, allowing the sprinklers to be set once at installation without fear of random surges occurring at some sprinkler heads due to other sprinkler heads having diminished water flows. Sprinklers under the current invention can be constructed with more than two water outlets, however flow should be apportioned among the various outlets in a manner that maintained a constant overall flow for the sprinkler head.

An added benefit of the reciprocating sprinkler head is that it can be used with a higher water flow rate than is possible with existing sprinklers. There is no maximum distance (at less than maximum water flow) between reciprocating sprinkler heads as there is with normal sprinkler heads.

Lawns with mounds or rolling areas often must be hand-watered or over-watered in order to avoid dry spots. This is because sprinkler overlap and water drop collision patterns are distorted by the uneven surface. The reciprocating sprinkler helps alleviate these problems because its operation does not depend on sprinkler overlap or water drop collision to get water to any portion of the area within its maximum spray pattern perimeter.

The present invention offers several advantages over prior art systems. First, more water coverage is obtained from higher periodic pressure through a selected outlet. Second, there is lower material and installation costs from using much fewer sprinkler heads and pipe connection. Third, there is less hardware and thus shorter installation time. Fourth, fewer components requires less maintenance because there are fewer sprinkler heads to adjust or replace. Fifth, water is saved. More evenly watered surfaces mean there is less overwatering. Finally, the present invention increases the aesthetic value of the lawn because there are fewer sprinkler heads installed in the lawn.

Having described and illustrated the principles of the invention in a preferred embodiment thereof, it should be apparent that the invention can be modified in arrangement and detail without departing from such principles. Also, the invention is not limited in its use to watering lawns. For example, it could be used as a fire sprinkler. I claim all modifications and variation coming within the spirit and scope of the following claims.

I claim:

1. A reciprocating sprinkler device for dispensing water uniformly over an area, comprising:

a housing;

an inlet port for receiving water under an inlet pressure into the housing;

at least two outlet ports from the housing, each outlet port having a receiving end in fluid communication with fluid entering the housing from the inlet port and a dispersing end external from the housing; a water powered drive mechanism powered by fluid communication with the inlet pressure; and a reciprocating valve driven by the water powered drive mechanism to shunt varying flows of water between the outlet ports so as to reciprocally increase and decrease the flows from each outlet port to distribute said flows radially from the sprinkler device;

wherein said outlet ports include at least a first opening and a second opening, wherein the reciprocating valve includes a cylindrical outer surface abutting said first and/or second openings and having a sloped top surface with a high end and a low end, said cylindrical surface substantially spanning the space between the first and second openings and covering at least a portion of said openings to present a cylindrical surface abutting against at least a portion of the first and/or second opening when the valve is rotated.

2. The device of claim 1, wherein said top sloped surface is planar.

3. The device of claim 1, wherein the top sloped surface has at least three coplanar high ends and three corresponding low ends.

4. The device of claim 1 wherein the top sloped surface has an odd number of high ends and an odd number of corresponding low ends.

5. In a fluid dispersing device having a housing, an inlet port in the housing for receiving a fluid driven under pressure, and a reciprocating valve, a method for uniformly dispersing a fluid in an area, comprising:

driving the fluid under pressure toward a first and a second dispersing outlet within the housing to establish a corresponding first and second outlet pressure;

periodically varying the first outlet fluid pressure from a first maximum value to a first minimum value thereby creating a radially extending spray pattern;

periodically varying the second outlet fluid pressure from a second maximum value to a second minimum value, reciprocally with the varying of the first outlet fluid pressure, thereby creating a radially extending spray pattern of fluid displacement which reaches a maximum displacement distance from the respective dispersing outlets when the respective maximum pressure values occur;

placing a second fluid dispersing device, having a second maximum displacement distance, so that the respective maximum displacement distances of the dispersing devices are at most coincident to one another.

6. A reciprocating sprinkler device for dispensing a fluid uniformly over an area, comprising:

a housing;

an inlet port for receiving the fluid under an inlet pressure into the housing;

at least two outlet ports from the housing, each outlet port having a receiving end in fluid communication with fluid entering the housing from the inlet port and a dispersing end external from the housing, wherein said outlet ports include at least a first opening and a second opening;

a fluid powered drive mechanism powered by fluid communication with the inlet pressure; and a reciprocating valve driven by the fluid powered drive mechanism to shunt varying flows of fluid between the outlet ports so as to reciprocally increase and decrease the flows from each outlet port to distribute said flows radially from the sprinkler device, wherein the reciprocating valve includes a cylindrical outer surface abutting said first and/or second openings and having a sloped top surface with a high end and a low end, said cylindrical surface substantially spanning the space between the first and second openings and covering at least a portion of said openings to present a cylindrical surface abutting against at least a portion of the first and/or second opening when the valve is rotated.

* * * * *